US006561174B1

(12) United States Patent
Afshari

(10) Patent No.: US 6,561,174 B1
(45) Date of Patent: May 13, 2003

(54) ARROW REST

(76) Inventor: Abbas Ben Afshari, 1553 E. Center, Pocatello, ID (US) 83201

( * ) Notice: Subject to any disclaimer, the term of this patent is extended or adjusted under 35 U.S.C. 154(b) by 0 days.

(21) Appl. No.: 09/771,944

(22) Filed: Jan. 29, 2001

Related U.S. Application Data

(60) Provisional application No. 60/178,463, filed on Jan. 27, 2000.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | | |
|---|---|---|---|---|---|
| 3,342,173 | A | * | 9/1967 | Ferguson | |
| 4,676,220 | A | * | 6/1987 | Pietraszek | |
| 5,503,136 | A | * | 4/1996 | Tone | 124/44.5 |
| 5,606,961 | A | * | 3/1997 | Basik et al. | 124/44.5 |
| 5,676,121 | A | * | 10/1997 | Bizier | 124/44.5 |
| 5,722,381 | A | * | 3/1998 | Mizek | 124/44.5 |
| 6,021,769 | A | * | 2/2000 | Troncoso | 124/44.5 |
| 6,082,348 | A | * | 7/2000 | Savage | 124/44.5 |

OTHER PUBLICATIONS

Reflex Product Catalog, p. 10 with Front and Back Covers.
Bowhunters, Spring Edition 1998, Product Catalog, pp. 44–52 with Front Cover.
Cabela's Archery '98, Product Catalog, pp. 34–35 with Front and Back Covers.
Kinseys Archery Product, 1998 Archery Products Catalog, pp. 160–180 with Front and Back Covers.
HCA, High Country Archery, Inc., 1999 Product Catalog, p. 13 with Front and Back Covers.
Hoyt USA, 1999 Hoyt USA Product Guide, p. 46 with Front and Back Covers.
Mathews Solocam, 1999 Product Catalog, p. 10 with Front and Back Covers.
PSC Archery Year 2000 Archery Product Catalog, pp. 13–23, p. 58 with Front and Back Covers.
Hoyt USA Product Guide 2000, p. 34 with Front and Back Covers.

* cited by examiner

*Primary Examiner*—John A. Ricci
(74) *Attorney, Agent, or Firm*—Morriss, Bateman O'Bryant & Compagni

(57) ABSTRACT

An arrow rest for an archery bow includes a mounting bracket for mounting to the riser of a bow, a shaft rotatably attached to the mounting bracket, a pair of arms configured for supporting the shaft of an arrow attached to the shaft, and a support member attached to said shaft for rotation therewith. A first magnet is attached to the mounting bracket and as second magnet is attached to the support member. The magnets are oriented to be attracted to one another to form a magnetic spring between the mounting bracket and the support member. The magnet spring holds the pair of arms in a first position for launching of an arrow from the bow but allow pivotal rotation of the arms upon launching of the arrow so that the arrow rest creates minimal drag on the shaft of the shaft of the arrow.

30 Claims, 6 Drawing Sheets

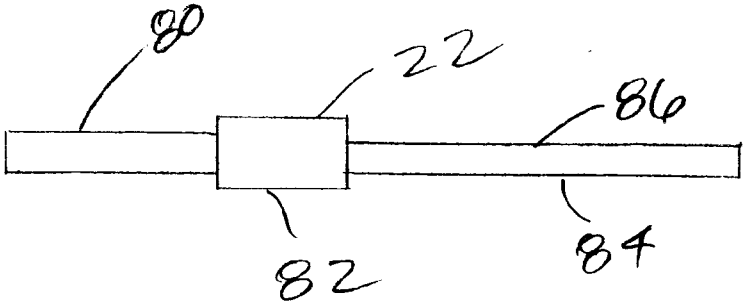
FIG. 5
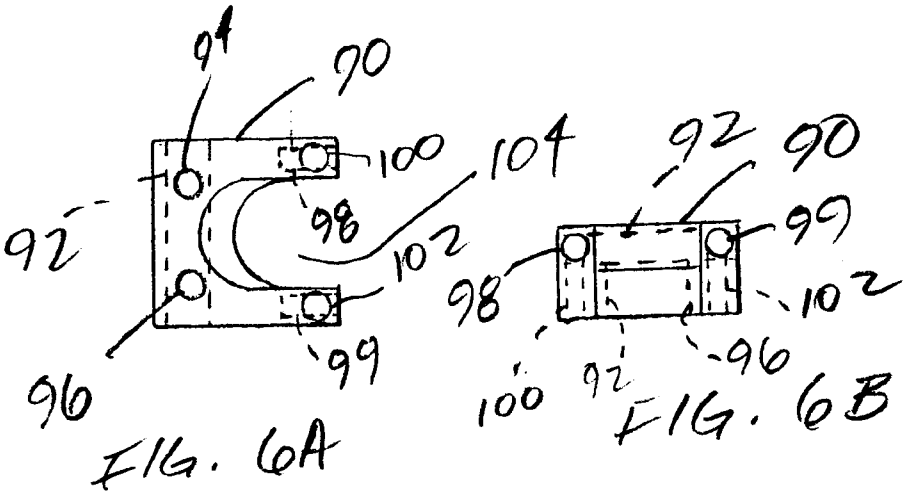
FIG. 6A
FIG. 6B

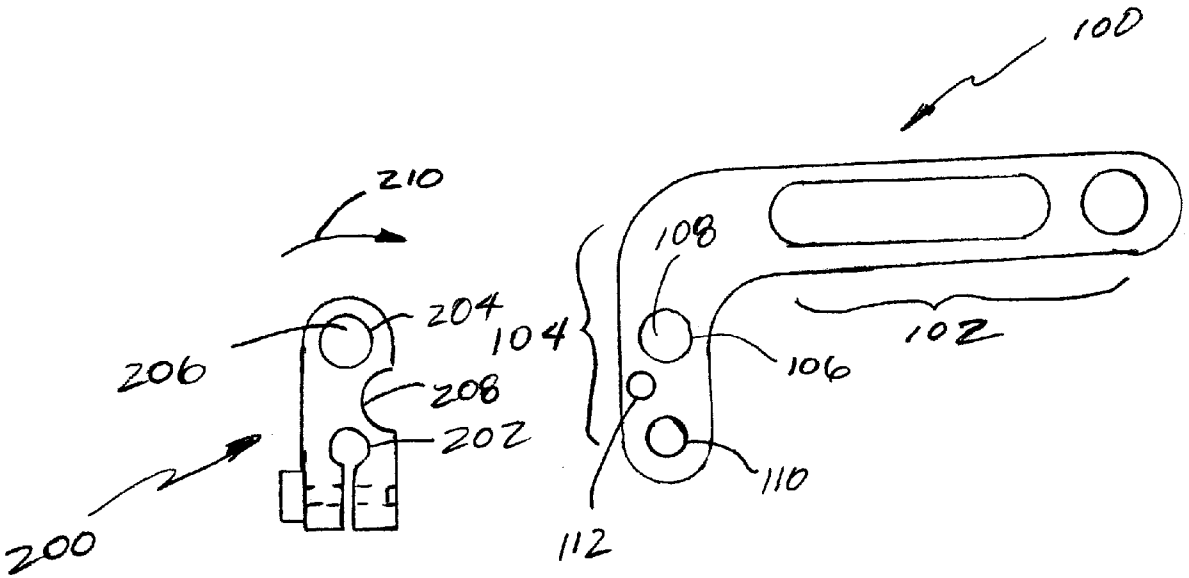
FIG. 9B
FIG. 9A
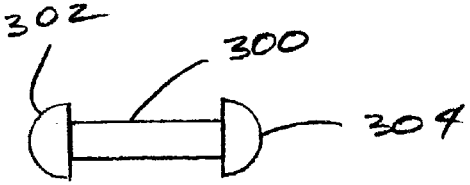
FIG. 9C

ARROW REST

CROSS-REFERENCED TO RELATED APPLICATIONS

This application claims priority to U.S. patent application Ser. No. 60/178,463, filed on Jan. 27, 2000.

BACKGROUND

1. Field of the Invention

The present invention relates to an apparatus for supporting the shaft of an arrow when launch from an archery bow. More particularly, the present invention relates to an arrow rest that includes one or more arms that are biased to a first, resting position and can move to a second, launching position when an arrow is launched from the bow.

2. Description of the Prior Art

Over the past few decades, the interest in the sport of archery in the United States has significantly increased. In particular, the number of sportsmen and sportswomen who hunt using a bow has continued to rise. As a result of this growth, the number of archery products manufacturers and the development of new archery products has greatly expanded.

For many years, recurve bows were the only kind of bow available. Once the compound bow was introduced, the interest and, naturally, the number of accessories for compound bows increased. Such accessories include various types of sighting apparatuses, stabilizing devices, and devices for supporting the shaft of the arrow when an arrow is drawn prior to launching. The first arrow rests typically comprised a V-shaped tab of plastic that was attached to the riser of the bow. The shaft of the arrow rests within the V of the arrow rest while the archer aims the bow toward a target. It was quickly discovered that the friction between the shaft of the arrow and the arrow rest and/or the contact between the arrow rest and the feathers on the aft end of the arrow can effect the trajectory and direction of flight of the arrow.

To address this problem, arrow rests are typically formed from a flexible material, such as plastic. By using a flexible material, the arrow rest can flex out of the way when the arrow is launched from the bow. Such a plastic arrow rest, however, has its drawbacks. For example, the plastic tab arrow rest typically flexes in a direction transverse to the direction of flight of the arrow. As such, contact between the fletches of an arrow and the arrow rest can still effect the flight of the arrow.

In order to provide a more stable support for an arrow and to allow the arrow rest to flex away from the shaft in the direction of the flight of the arrow, arrow rests have been developed that include a pair of arms. The tips of the arms support the shaft of the arrow. The arms are typically attached to or integrally formed with a rotatable shaft that is rotatably mounted to a mounting bracket. The mounting bracket is configured for attachment to the riser of a compound bow. In addition, the shaft is biased relative to the mounting bracket so that the arms are biased toward the shaft of an arrow when the arrow is resting upon the tips of the arms. The biasing of the arms is provided by a coil spring interposed between the mounting bracket and the rotatable shaft.

When an arrow is launched from a bow utilizing such an arrow rest, the impact of the fletches of the arrow upon the arms of the arrow rest will cause the arms to rotate downwardly. After the fletches pass the arms, the coil spring then causes the arms to rotate bak to their pre-launch position.

Because the arms are forced away from their resting position and then quickly return to the resting position after passage of the arrow, the arms "snap" back into place. In order to stop the arms from rotating passed their pre-launch position, an abutment is provided to stop the rotation of the rotatable shaft. The snapping action of the arrow rest caused by contact with the abutment results in a relatively loud noise generated by contact with the abutment every time an arrow is launched.

In a hunting setting, noise is a major factor in the ability to stalk an animal. Hunters take great strides to maintain silence in the wild so as to not startle the game. If an arrow is shot toward an animal, any noise is likely to cause the animal to flee or at least move to a degree that causes the arrow to miss its intended target. Thus, it is often the case that such arrow rests startle animals every time an arrow is launched.

Thus, it would be advantageous to provide an arrow rest that is relatively quiet in operation. In addition, it would be advantageous to provide an arrow rest that relatively rigidly supports the shaft of the arrow before it is launched from a bow while providing little resistance against the shaft as the shaft slides along the arrow rest during the launch sequence.

SUMMARY OF THE INVENTION

These and other advantages will become apparent from a reading of the following summary of the invention and description of the preferred embodiments in accordance with the principles of the present invention.

Accordingly, an arrow rest comprises a mounting member configured for mounting to a bow, a first magnet mounted to the mounting member with an outwardly facing polarized end, an elongate shaft rotatably mounted to the mounting member, a support member mounted to the shaft and rotatable therewith and having a second magnet mounted thereto, the second magnet positioned to face the first magnet and oriented with its oppositely polarized end facing the polarized end of the first magnet, at least one arm mounted to the shaft configured for supporting the shaft of an arrow placed thereon.

In a preferred embodiment, the mounting member has a first portion configured for mounting to the bow and a second portion having a transversely extending bore for receiving the elongate shaft.

In another preferred embodiment, the second portion further includes a first chamber, a second chamber and a third chamber spaced a distance from the shaft, the first chamber housing the first magnet, the second and third chambers housing third and fourth magnets, respectively, the third and fourth magnets positioned proximate to the first magnet with their outwardly facing ends having an opposite polarization to the outwardly facing end of the first magnet.

In still another preferred embodiment, the mounting member and the support member are comprised of a non-magnetically attractive material.

In yet another preferred embodiment, the arrow rest further includes a stopping mechanism for preventing over rotation of the arm after the arm is forced back to the first position by the magnetic attracting of the first and second magnets.

Preferably, the stopping mechanism comprises an abutment member secured to the mounting bracket. A padding material is preferably attached to the abutment member for silencing the abutment member when contacted by the biasing support member.

In another preferred embodiment, the arrow rest includes a pair of arms attached to the shaft and a pair of tip members secured to the pair of arms. The tip members are spaced apart to support the shaft of an arrow.

In yet another preferred embodiment, the tip members are removably secured to the ends of the arms so that as the tip members become worn from repeated use, they can be replaced.

Likewise, it is preferable that the arms are releaseably secured to the shaft.

The arms are preferably supported by a U-shaped member such that the arms are attached to the first and second legs, respectively, of the U-shaped member.

BRIEF DESCRIPTION OF THE DRAWINGS

The foregoing summary, as well as the following detailed description of the preferred embodiments is better understood when read in conjunction with the appended drawings. For the purpose of illustrating the invention, there is shown in the drawings embodiments that are presently preferred and which illustrate what is currently considered to be the best mode for carrying out the invention, it bing understood, however, that the invention is not limited to the specific methods and instruments disclosed. In the drawings:

FIG. 5 is a side view of a preferred embodiment of a shaft in accordance with the principles of the present invention;

FIG. 6A is a top view of a preferred embodiment of an arrow rest arm support member in accordance with the principles of the present invention;

FIG. 6B is an end view of the arrow rest arm support member shown in FIG. 6*a;*

FIG. 9A is a side view of a second preferred embodiment of an arrow rest mounting bracket in accordance with the principles of the present invention;

FIG. 9B is a side view of a second preferred embodiment of a biasing support member in accordance with the principles of the present invention; and FIG. 9C is a side view of a biasing member in accordance with the principles of the present invention.

DETAILED DESCRIPTION OF THE PREFERRED EMBODIMENTS

Figure 1:
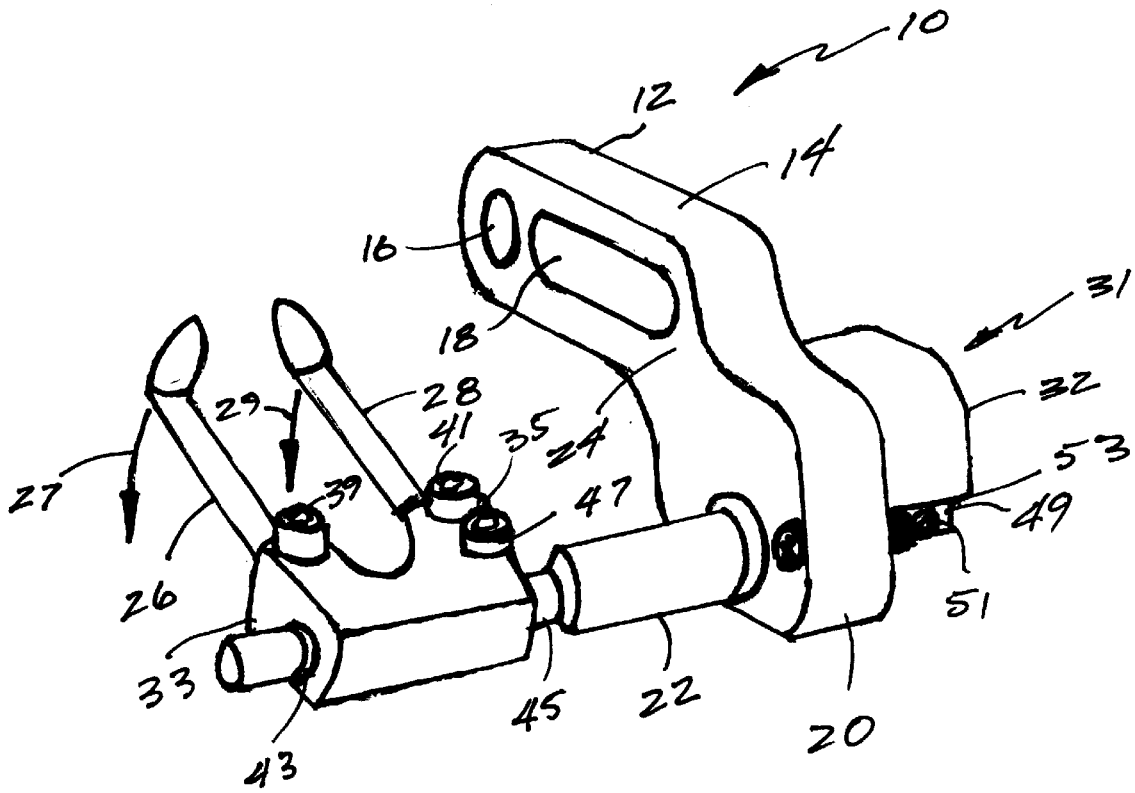
FIG. 1 is a perspective view of a first preferred embodiment of an arrow rest in accordance with the principles of the present invention.

Referring to the drawings wherein like numerals indicate like elements throughout, there is shown in FIG. 1 an arrow rest, generally indicated at 10, in accordance with the principles of the present invention. The arrow rest 10 is comprised of a mounting member 12 configured for mounting to the riser of an archery bow (not shown), such as a compound hunting bow. The mounting member or bracket 12 has a first portion 14 defining a threaded bore 16 and an elongate slot or aperture 18 configured to mount the arrow rest 10 to a bow. The mounting bracket has a second portion 20 to which an elongate shaft 22 is rotatably mounted. The shaft 22 extends on both sides of the mounting bracket 12. On a first side 24 of the mounting bracket 12 a pair of arrow rest members or arms 26 and 28 are mounted to the shaft 22. On a second side 30 of the mounting bracket 12, a biasing support member 32 is mounted to the shaft 22.

In use, the arrow rest arms 26 and 28 can deflect relative to the mounting bracket 12, as shown in the direction of arrows 27 and 29, as the fletching or feathers on an arrow (not shown) passes by the arrow rest arms 26 and 28, but are returned to their pre-launch position by the biasing device, generally indicated at 31. As further illustrated the arrow rest members 26 and 28 are fastened to the shaft 22 with mounting member 34 which is fixedly mounted to the shaft 22 and fixedly holds the arrow rest members 26 and 28 relative to the shaft 22.

The mounting member 34 has a U-shaped configuration with a pair of bores (not shown) formed in the legs 33 and 35. The ends of the arms 26 and 28 are inserted into the bores and held in place with set screws 39 and 41. The arm mounting member 34 is provided with a transversely extending bore 43 for receiving a portion of the shaft 22 therein. The shaft 22 has a flattened side 45. The mounting member 34 is provided with a bore and a set screw 47 to secure the mounting member 34 to the shaft 22. By tightening the set screw 47 against the flattened side 45 of the shaft 22, the mounting member 34 will automatically orient itself properly relative to the mounting bracket 12. This automatic orientation is also accomplished by the proper positioning of the biasing support member 32 which is itself automatically aligns with the mounting member by use of the biasing device 31 as will be explained in more detail in accordance with the principles of the present invention.

A recess 49 or cutout portion is formed in the biasing support member 32. An abutment member 51 is secured to the mounting member 12 and is positioned to contact the abutment surface 53 of the biasing support member 32 when the arms 26 and 28 are over rotated in a direction opposite the arrows 27 and 29. The abutment member 51 is covered with a silencing material to absorb the impact with the surface 53 and thus deaden the sound. Likewise, the surface 53 could be padded or the entire biasing support member could be formed from a rubber or rubber-coated material.

Figure 2:
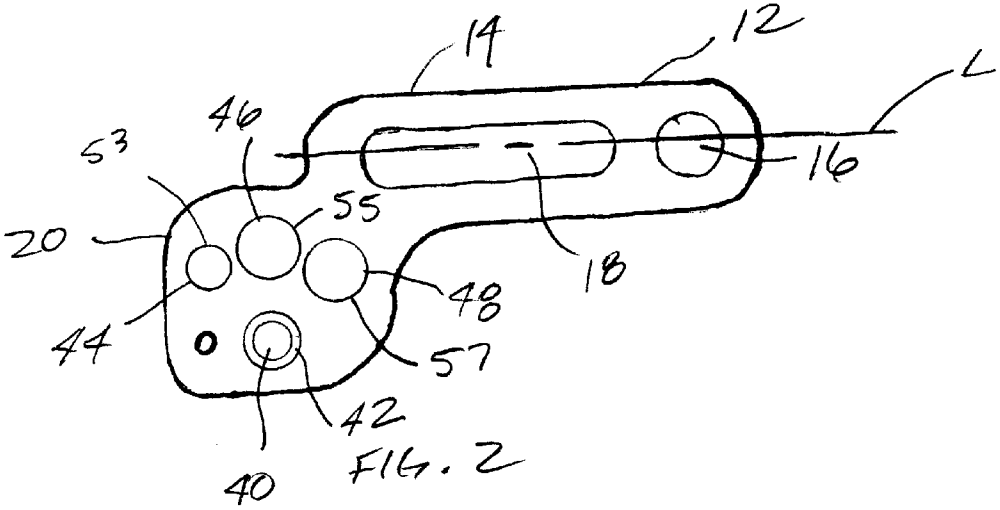
FIG. 2 is a side view of a first preferred embodiment of a mounting bracket in accordance with the principles of the present invention.

Referring now to FIG. 2, the mounting bracket 12 is formed from an integral member having the first portion 14 for mounting to a bow with threaded bore 16 and slot 18. The slot 18 is provided to allow attachment of the arrow rest 10 to variously configured bows and for adjustment relative to a bow. The second portion 20 is transversely offset from the longitudinal axis L of the first portion 14 in order to position the arms 26 and 28 of FIG. 1 in the proper location for properly supporting the shaft of an arrow. The second portion 20 includes a transversely extending bore 40 to which the shaft 22 is rotatably mounted. A bearing 42, such as a tube-like plastic insert, is provided in the bore 40 to provide quiet and smooth rotation of the shaft 22 therein. Arcuately positioned around the bore 40 are three permanent magnets 44, 46 and 48. The magnets 44, 46 and 48 may be of different sizes, and thus different strengths, depending upon the magnetic push or pull needed to for an adequate magnetic spring in accordance with the principles of the present invention.

Figure 3:
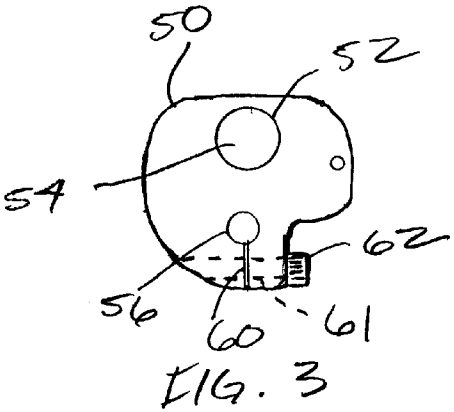
FIG. 3 is a side view of a first preferred embodiment of a biasing support member in accordance with the principles of the present invention.

With reference also to FIG. 3, the magnets 44, 46 and 48 shown in FIG. 2 are arranged to encourage the a biasing support member 50 to return to its pre-launch position, such as the position of the biasing device 32 shown in FIG. 1. The biasing support member 50 is provided with a chamber 52, similar to the chambers 53, 55 and 57 of the mounting bracket 12, for holding another permanent magnet 54. The biasing support member 50 also includes an aperture 56 at its lower end for mounting to the shaft 22. The aperture 56 is further defined by an elongate slot 60 transversely extending through an elongate bore 61 into which a threaded fastener 62 may be attached. By placing the biasing support member 50 upon the shaft 22, the biasing support member 50 will automatically orient itself properly relative to the mounting bracket 12 since the magnet 54 is oriented to be magnetically attracted to the magnet 46. Upon tightening of the fastener 62, the slot 60 is forced together and the size of the aperture 56 is decreased thus tightening the aperture and securing the aperture 56 around the shaft 22. Of course, those of skill in the art will appreciate that other means of attaching the biasing support member to the shaft as with a set screw, adhesive attachment, compression fit attachment and the like.

When the biasing support member 50 is attached to the shaft 22 so that the face of the magnet 54 is aligned with face of the magnet 46, rotation of the shaft 22 is biased by the magnetic fields generated by the permanent magnets. In particular, magnets 44, 48 and 54 are oriented so that their similar polar ends face one another, and thus tend to repel one another. The magnet 46 is oriented so that its oppositely charged polar end faces the magnet 54. As such, magnets 46 and 54 are attracted to one another. By repelling the magnet 54, the magnets 44 and 48 encourage the magnet 52 to stay facing the magnet 46.

The biasing support member 50 is secured to the shaft 22 so that the face of the magnet 46 is spaced a relatively small distance from the magnet 54 when the magnets 46 and 54 are at their closest relative positions. Additionally, the biasing support member 50 does not contact the mounting bracket 12 upon rotation of the biasing support member 50 relative to the mounting bracket. As such, there is no frictional contact between the mounting bracket 12 and the biasing support member 50 upon rotation of the biasing support member 50. Proper spacing between the mounting bracket 12 and the biasing support member 50 may be provided by the bearing 42. That is, the bearing 42 may extend a small distance from the side of the mounting bracket 12. The biasing support member 50 can then be abutted against the bearing 42 when attached to the shaft 22 to provide adequate spacing between the mounting bracket 22 and the biasing support member 50.

In operation, the biasing support member 50 is encouraged to orient itself so that the magnet 54 substantially aligns itself with the magnet 46. Further, rotation of the shaft 22 is discouraged by the negative attraction of the magnets 44 and 48 and the positive attraction of magnet 46 relative to magnet 54. Of course the magnet 54 may be oriented in either direction, i.e., either having its positive or negative end facing out, so long as the magnets 44 and 48 are also oriented with the same end as magnet 54 facing out and the magnet 46 having its oppositely charged end facing out so as to attract the magnet 54.

Figure 4:
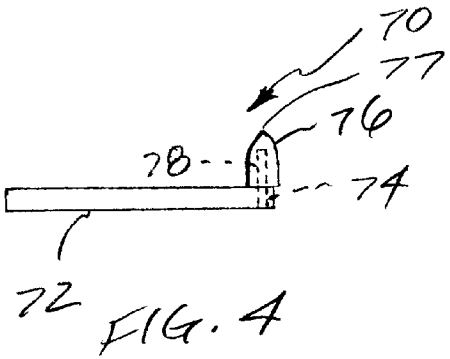
FIG. 4 is a side view of a preferred embodiment of an arrow rest arm in accordance with the principles of the present invention.

Referring now to FIG. 4, the arrow rest arm 70 is illustrated comprising an elongate arm member 72 preferably comprised of a cylindrical shaft having a transversely extending threaded bore 74 extending therethrough. A bullet shaped tip 76 attached to an externally threaded shaft 78 is threadedly attached to the bore 74 to that the tip 76 is oriented substantially perpendicular to the arm 72. The arm 72 is preferably comprised of metal while the tip 76 is preferably comprised of a softer material, such as plastic to prevent damage to the shaft of an arrow sliding therethrough. In addition, the tip 76 is formed from a material such as plastic so as to reduce noise as the arrow slides therethrough. A Teflon tip or tip formed from a material that allows the arrow shaft to easily and with little friction slide along the tip will help reduce the effect of the tips on the trajectory of the arrow. The tip 76 also has a relatively sharp point 77 so as to provide minimal surface area for contact between the tip and the shaft of the arrow resulting in less frictional effect on the shaft of the arrow by the tip 76.

As shown in FIG. 5, the shaft 22 has a first portion 80 to which the mounting bracket 12 and biasing member 50 are secured, a larger diameter abutment portion 82 for abutting against the mounting bracket and preventing the shaft from substantial movement in a longitudinal direction relative to the mounting bracket 12, and an arrow rest arm mounting portion 84 for mounting the arm 70. The mounting portion 84 is provided with a flattened side 86 so that upon mounting the arms thereto, the arms are prevented from rotation relative to the shaft. Plastic washers (not shown) may be provided along the shaft and interposed between the various components to provide quiet and low friction rotational engagement of the various components attached thereto.

Referring now to FIGS. 6A and 6B, the arms are mounted to the shaft 22 with a U-shaped arm mounting member 90. The mounting member 90 may be formed from a single piece as is illustrated or divided into two members, one for each arm. The mounting member 90 has first and second legs with a first transverse bore 92 for mounting to the shaft as with set screws 94 and 96. The arms are mounted to the mounting member 90 by inserting the arms into bores 98 and 99 formed in each of the legs of the mounting member. The arms are secured in place with set screws 100 and 102. The mounting member defines a horseshoe or U-shaped opening 104 for passage of the shaft of an arrow therethrough.

Figure 7:
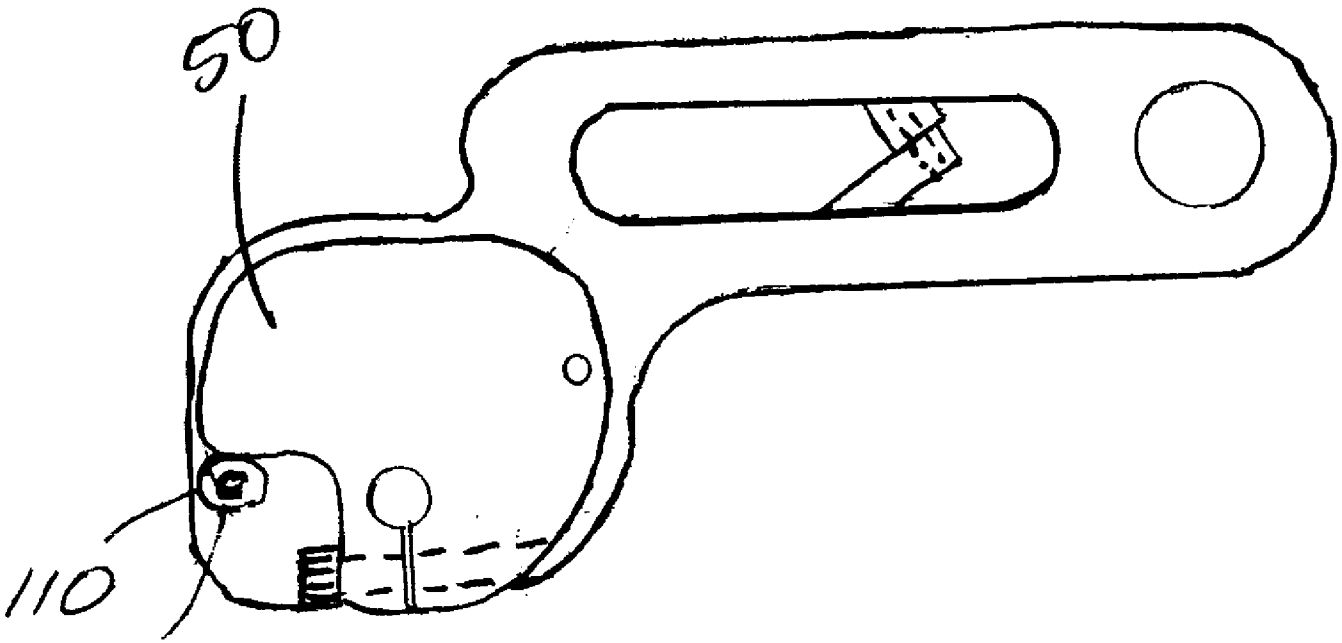
FIG. 7 is a side view of the arrow rest shown in FIG. 1.
Figure 8:
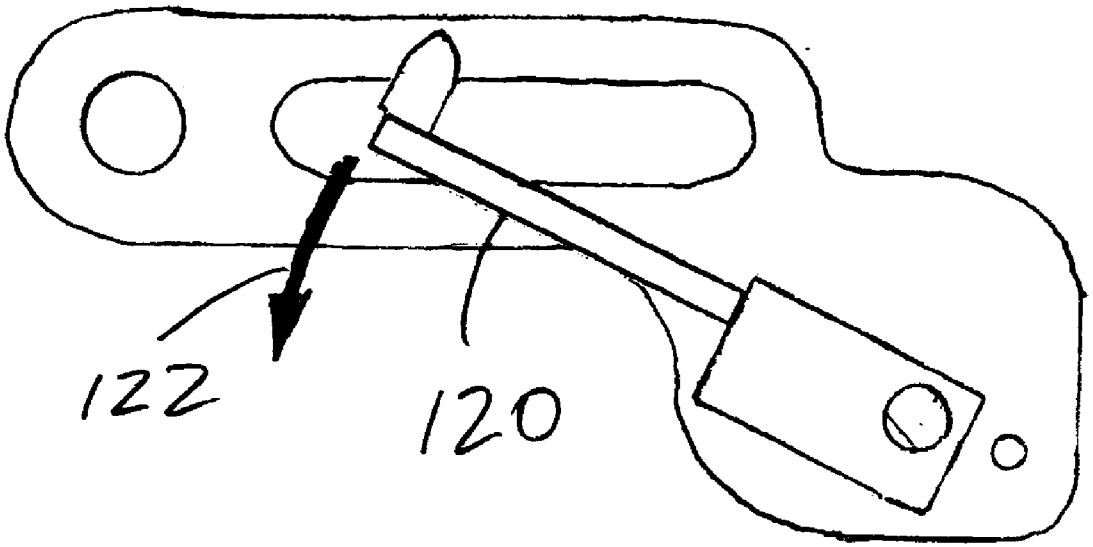
FIG. 8 is a side view of the arrow rest shown in FIG. 1.

When assembled, as is shown in FIG. 7, the biasing member 50 is prevented from over rotation by a padded abutment member 110. The abutment member 110 is preferably comprised of an externally threaded shaft threadedly mounted to the mounting bracket 12 having an O-ring 112 or other padding material placed thereon. Viewed from the side of the arrow rest of FIG. 8, when the arms 120 are forced in the direction of the arrow 122 when shooting an archery arrow, the magnet arrangement biases the arms 120 in the opposite direction to the arrow 122. Unlike spring type biasing devices, the magnets provide relatively constant resistance or biasing force to the arms and thus have less of an affect on the trajectory of a arrow shot through the arrow rest. In addition, the arrow rest of the present invention is virtually silent. The use of the magnets and the padded abutment member allow the arms to be forced in one direction by the launching of an arrow there through with rapid return to their pre-launch position with little or no noise. Such a silent arrow rest is extremely advantageous when hunting game that are particularly sensitive to noise in the wild.

Those of skill in the art will appreciate that various modifications may be made to the present invention without departing from the spirit and scope of the invention. For example, as shown in FIGS. 9A and 9B, a simplified version of a mounting bracket, generally indicated at 100, and a biasing support member, generally indicated at 200, are illustrated in accordance with the present invention. The mounting bracket 100 is an L-shaped member having a first portion 102 for mounting or coupling to a bow and a second portion 104 for providing a part of the magnetic spring in accordance with the principles of the present invention. Similar to other embodiments described herein, the second portion includes an aperture or chamber 106 for housing a magnet 108, a transversely extending bore 110 for receiving and rotating upon the shaft (not shown), and an abutment member 112 secured thereto for preventing rotation of the biasing support member 200 passed the abutment member 112.

The biasing support member 200 includes a clamping aperture 202 for fixedly attaching the support member 200 to the shaft (not shown) and an aperture or chamber 204 for housing a magnet. A recessed surface 208 is formed in the side of the support member 200 to abut against the abutment member 112 if the support member 200 is rotated to far in the direction shown by arrow 210. It should be apparent that the support member 200 would be flipped over so that the magnet 206 faces the magnet 108 when attached to the shaft.

In this preferred embodiment, the device only utilizes two magnets 108 and 206 which have opposite polarities facing each other so that the magnets 108 and 206 are attracted to one another. By preventing actual contact between the magnets 108 and 206 while providing free rotation of the support member 200 relative to the mounting member 100, the magnets 108 and 206 form a magnetic spring. It is also contemplated however, that the magnetic attraction between a single magnet and a magnetically attractive metal, such as iron or an iron alloy, may provide sufficient magnetic pull to form a magnetic spring in accordance with the principles of the present invention. Thus, the "magnet" 206 may be a piece of iron inserted into the chamber 204. Likewise if the magnet 206 is a permanent magnet, the "magnet" 108 may comprise a piece of steel.

As shown in FIG. 9C, it is further contemplated that a section of resilient material, such as a cylindrically shaped section of rubber 300, secured to and between the mounting member and the biasing support member could also be utilized to provide the biasing device of the present invention. Such a section of rubber 300 could be adhesively or mechanically attached, as with head portions 302 and 304 inserted through apertures 106 and 204 and resting on the outside surfaces of the members 100 and 200 shown in FIGS. 9A and 9B. Similarly, other spring-like members could be employed that would maintain the silence of the device. Such a biasing device 300 may also eliminate the need for the stopping or abutment member 112 since the structure of the biasing member 300 would force the member 200 and thus the arms to return to their pre-launch positions.

Because of the use of magnets for forming a biasing device, the mounting bracket 100 and the support member 200 are preferably formed from a non-magnetically attractive material such as aluminum, or other metals, alloys, plastics, or other materials known in the art that are not significantly attracted to magnets.

While the apparatus of the present invention has been described with reference to certain preferred embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. An arrow rest, comprising:

a mounting member configured for mounting to a bow;

a first magnet mounted to said mounting member with an outwardly facing polarized end;

an elongate shaft rotatably mounted to said mounting member;

a support member mounted to said shaft and rotatable therewith and having a second magnet mounted thereto, said second magnet positioned to face said at least one first magnet and oriented with its oppositely polarized end facing said polarized end of said first magnet; and at least one arm mounted to said shaft configured for supporting the shaft of an arrow placed thereon.

2. The arrow rest of claim 1, wherein said mounting member has a first portion configured for mounting to the bow and a second portion having a transversely extending bore for receiving said elongate shaft therein.

3. The arrow rest of claim 2, wherein said second portion further includes a first chamber, a second chamber and a third chamber spaced a distance from said shaft, said first chamber housing said first magnet, said second and third chambers housing third and fourth magnets, respectively, said third and fourth magnets positioned proximate to said first magnet with their outwardly facing ends having an opposite polarization to the outwardly facing end of the first magnet.

4. The arrow rest of claim 1, wherein said mounting member and said support member are comprised of a non-magnetically attractive material.

5. The arrow rest of claim 1, further including a stopping mechanism for preventing over rotation of said at least one arm substantially passed a first position after said at least one arm is rotated to a second position and then is forced back to said first position by the magnetic attracting of said first and second magnets.

6. The arrow rest of claim 5, wherein said stopping mechanism comprises an abutment member secured to said mounting bracket and further including a padding material attached to said abutment member for silencing said abutment member when contacted by said biasing support member.

7. The arrow reset of claim 1, wherein said at least one arm comprises a pair of arms attached to said shaft, and further comprising a pair of tip members, each secured to one of said pair of arms, said tip members spaced apart to support the shaft of an arrow.

8. The arrow rest of claim 7, wherein said tip members are removably secured proximate to an end of said pair of arms.

9. The arrow rest of claim 1, wherein said at least one arm comprises first and second arms, each of said first and second arms comprising an elongate member secured to an arm support member, said arm support member releaseably securable to said shaft.

10. The arrow rest of claim 9, wherein said arm support member comprises a U-shaped member, said first and second arms attached to first and second legs, respectively, of said U-shaped member.

11. An arrow rest, comprising:

a mounting bracket configured for mounting to a bow;

a shaft rotatably mounted to said mounting bracket;

at least one arm mounted to said shaft, said at least one arm configured for supporting the shaft of an arrow;

a biasing support member secured to said shaft and rotatable therewith, a biasing device comprising a first magnet secured to said mounting bracket and a second magnet secured to said biasing support member for biasing said member toward a first position.

12. The arrow rest of claim 11, further including a stopping mechanism for preventing over rotation of said at least one arm substantially passed said first position after said at least one arm is rotated to a second position and then returns to said first position.

13. The arrow rest of claim 12, wherein said stopping mechanism comprises an abutment member secured to said mounting bracket.

14. The arrow rest of claim 13, further including a padding material attached to said abutment member for silencing said abutment member when contacted by said biasing support member.

15. The arrow reset of claim 11, wherein said at least one arm comprises a pair of arms attached to said shaft, and further comprising a pair of tip members, each secured to one of said pair of arms, said tip members spaced apart to support the shaft of an arrow.

16. The arrow rest of claim 15, wherein said tip members comprise replaceable members, each removably secured proximate to an end of said pair of arms.

17. The arrow rest of claim 11, wherein said at least one arm comprises first and second arms, each of said first and second arms comprising an elongate member secured to an arm support member, said arm support member releaseably securable to said shaft.

18. The arrow rest of claim 17, wherein said arm support member comprises a U-shaped member defining a first bore in a first leg of said U-shaped member and a second bore in a second leg of said U-shaped member, said first and second bores configured for receiving first and second arms, respectively, said first and second arms positioned to support the shaft of an arrow.

19. The arrow rest of claim 18, further including first and second tip members, each secured proximate to an end of said first and second arms, respectively.

20. An arrow rest, comprising:

a mounting bracket configured for mounting to a bow;

a shaft rotatably mounted to said mounting bracket;

at least one arm mounted to said shaft, said at least one arm configured for supporting the shaft of an arrow;

a biasing support member comprised of a non-magnetically attractive material secured to said shaft and rotatable therewith; and a biasing device comprising a first magnet secured to said mounting bracket and a piece of magnetically attractive material secured to said biasing support member for biasing said member toward a first position.

21. The arrow rest of claim 20, wherein said biasing device comprises a first magnet secured to said mounting bracket and a second magnet secured to said biasing support member.

22. The arrow rest of claim 20, wherein said biasing support member is comprised of a non-magnetically attractive material and wherein said basing device comprises a first magnet secured to said mounting bracket and a piece of magnetically attractive material secured to said biasing support member.

23. The arrow rest of claim 20, further including a stopping mechanism for preventing over rotation of said at least one arm substantially passed said first position after said at least one arm is rotated to a second position and then returns to said first position.

24. The arrow reset of claim 20, wherein said at least one arm comprises a pair of arms attached to said shaft, and further comprising a pair of tip members, each secured to one of said pair of arms, said tip members spaced apart to support the shaft of an arrow.

25. The arrow rest of claim 20, wherein said at least one arm comprises first and second arms, each of said first and second arms comprising an elongate member secured to an arm support member, said arm support member releaseably securable to said shaft.

26. The arrow rest of claim 25, further including first and second tip members, each secured proximate to an end of said first and second arms, respectively.

27. An arrow rest, comprising:

a mounting member for mounting relative to a bow;

at least one support member coupled to said mounting member and pivotable relative thereto for supporting the shaft of an arrow;

at least one magnet secured relative to one of said mounting member and said at least one support member for biasing said at least one support member relative to said mounting member toward a first position;

a shaft rotatably mounted to said mounting member for coupling said at least one support member to said mounting member; and a biasing support member secured to said shaft and rotatable therewith, said at least one magnet comprising a first magnet secured to said mounting member and a second magnet secured to said biasing support member for biasing said biasing support member toward a first position.

28. The arrow rest of claim 27, wherein said at least one support member comprises at least one arm mounted to said shaft.

29. An arrow rest, comprising:

a mounting member for mounting relative to a bow;

at least one support member coupled to said mounting member and pivotable relative thereto for supporting the shaft of an arrow;

at least one magnet secured relative to one of said mounting member and said at least one support member for biasing said at least one support member relative to said mounting member toward a first position;

a shaft rotatably mounted to said mounting member for coupling said at least one support member to said mounting member;

a biasing support member secured to said shaft and rotatable therewith, said at least one magnet comprising a first magnet secured to said mounting member and a piece of magnetically attractive material secured to said biasing support member.

30. The arrow rest of claim 29, wherein said at least one support member comprises at least one arm mounted to said shaft.

* * * * *